United States Patent [19]

Westmoreland, Sr.

[11] 3,934,431

[45] Jan. 27, 1976

[54] HIGH SPEED KNITTING MACHINE AND METHODS

[75] Inventor: Robert W. Westmoreland, Sr., Roanoke, Va.

[73] Assignee: Fred Whitaker Company, Bala Cynwyd, Pa.

[22] Filed: Oct. 29, 1973

[21] Appl. No.: 410,807

Related U.S. Application Data

[63] Continuation of Ser. No. 821,447, May 2, 1969, abandoned.

[52] U.S. Cl. ..... 66/57; 66/90

[51] Int. Cl.[2] ..... D04B 15/00; D04B 15/32

[58] Field of Search ..... 66/8, 9 A, 104, 90, 57, 66/1 R, 54, 115, 107

[56] References Cited

UNITED STATES PATENTS

| | | | |
|---|---|---|---|
| 281,804 | 7/1883 | Simonson | 66/8 X |
| 1,114,539 | 10/1914 | Scott | 66/104 X |
| 1,770,469 | 7/1930 | Grieve | 66/107 X |
| 2,069,155 | 1/1937 | Lawson | 66/107 |
| 2,090,500 | 8/1937 | Lawson | 66/107 |
| 2,101,005 | 11/1937 | Lawson | 66/8 |
| 2,104,231 | 1/1938 | Lawson | 66/107 |
| 2,108,705 | 2/1938 | Broadwin | 66/8 |
| 3,007,325 | 11/1961 | Smith | 66/90 |

FOREIGN PATENTS OR APPLICATIONS

| | | | |
|---|---|---|---|
| 512,408 | 10/1920 | France | 66/115 |
| 34,599 | 8/1885 | Germany | 66/107 |
| 342,525 | 10/1918 | Germany | 66/115 |
| 7,459 | 4/1899 | United Kingdom | 66/107 |

OTHER PUBLICATIONS

APC Application of Meiwald, Serial No. 246,213, Published May 4, 1943.

*Primary Examiner*—Wm. Carter Reynolds

[57] ABSTRACT

A high speed continuous knitting machine wherein the cylinder has a substantially circular cam track for the needle butts having a substantially uniform slope and disposed at an oblique angle relative to the axis of the cylinder, and also including cam controlled axially moveable sliders disposed between the needles for assisting in castoff, which sliders are moved in a direction opposite to the direction of movement of the needles.

10 Claims, 5 Drawing Figures

HIGH SPEED KNITTING MACHINE AND METHODS

CROSS REFERENCE TO RELATED APPLICATIONS

This is a continuation of U.S. patent application Ser. No. 821,447, filed May 2, 1969. now abandoned.

SUMMARY

In conventional circular knitting machines, the needles travel vertically in their cylinder slots between two extreme positions. When a needle is at its highest point, the yarn loop formerly in its hooks has passed below ("cleared") the latches and new yarn is fed into the open hook. The needle is then carried down, in the "stitch drawing" phase, so that the newly fed yarn caught by the hook is pulled through the old loop. The latter causes the latch to close as the needle descends. At the lowest point, the top of the needle passes below the old loop which is thus "castoff".

In conventional systems, the yarn is drawn over the top of the radially extending fins or walls that form the slots for the needles. These walls, of course, are immoveable and are of a standard height.

In conventional systems, the needles are thus required to travel vertically a relatively great distance between clearing and castoff. As a general rule, needles are required to move vertically about at least three-quarters of an inch on such machines. The distance increases when the cams are adjusted to draw longer stitches or if needles with longer latches are used.

On conventional machines, the stitch cams utilized to draw needles down to castoff level are designed to provide a steep descending slope (about 45° plus or minus about 5°). This relatively steep slope is necessary to insure that only a very few needles draw down upon the newly fed yarn at a given time. Otherwise, on such conventional machines, the force of many needles all drawing down at one moment would break the yarn. To my knowledge, no machine heretofore built has included stitch drawing cams having a slope more gradual than about 40°.

Thus, on conventional machinery, the needles are required to travel a relatively great vertical distance, and this travel must take place through a steep downward slope and in a small amount of angular space. It will be understood, therefore, that these factors present a definite practical limitation upon the speed at which the needles may rotate relative to the cams (or vice-versa). This, in turn, limits the amount of fabric that can be produced by the machine.

The foregoing observations, it should be noted, also apply generally to flat-bed and other types of warp knitting systems as to which the principles of the present invention also apply.

The object of the present invention is to design a knitting machine so that knitting can take place at several times the speed possible by conventional machinery.

To achieve the general object of this invention, I utilize a unique cam system for raising and lowering (i.e. projecting and retracting) the needles. That is, my invention includes the concept that, as applied to a circular machine, the needles should follow a path as close as possible to the horizontal and that, to the extent the path must be at an angle from the horizontal to provide the necessary height for clearing and castoff, that the path be substantially as uniform in slope as possible.

I have found that it is possible to utilize a cam track for the needles of substantially uniform slope and that such slope may be as small as about one degree from the horizontal and, in any event, substantially less than the conventional 40°–45° pitch of existing cam systems. In this connection, I have found that the castoff process is facilitated by the use of vertically moveable elements (which I call "sliders") disposed between the needles in the slots in the cylinder wall or other needle carrier or bed. The sliders are cam controlled so that those adjacent the needles descending to castoff are raised whereby the newly fed yarn is engaged by the ends thereof, thereby assisting the needles in drawing such yarn into new loops.

This invention has proved to be particularly valuable in connection with rotating cam circular machines of the type utilized in knitting fabrics in the so called knit-deknit procedures which are now employed by yarn processors. Thus, it has been discovered that the steps of dyeing and otherwise processing yarn are significantly facilitated if the yarn is in the form of a knitted fabric.

In the knit-deknit process, as the name implies, the yarn is first knit into a fabric. The fabric is then passed through the processing steps after which the fabric is unraveled (deknit) and wound about a suitable package.

When rotating cam circular knitting machines are employed, the fabric produced by the machine, of course, does not rotate (as it does on machines employing rotatable needle cylinders) so that the fabric drawn from the machine can be continuously passed into the processing operation. Thus, the speed of processing is tied to the speed at which knitting can take place. As indicated, one of the primary objects of this invention is to provide a circular knitting machine of the rotatable cam type which can produce fabric at several times existing speeds.

Other objects and attendant features of the invention will be best understood by reference to the following written description and the drawings, wherein.

Figure 5:
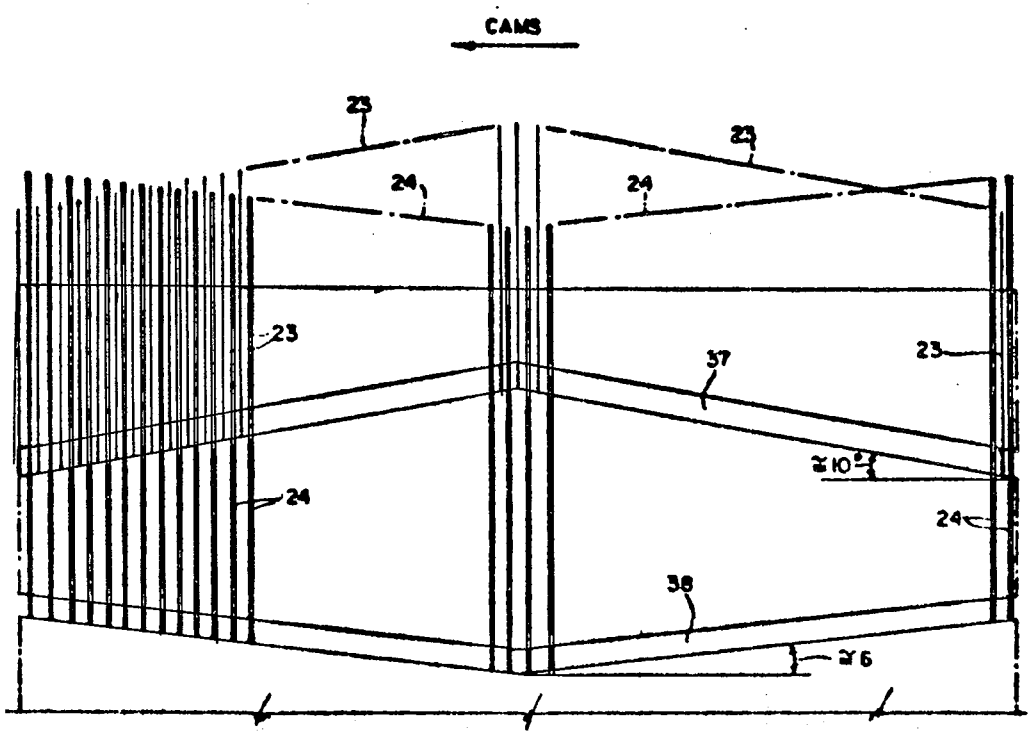

FIG. 5 is a diagrammatic view of the cams for the needle butts and the sliders, with the cylinder 21 and the tracks 37 and 38 laid out flat for convenience of explanation.

In the preferred embodiment, as illustrated herein, the invention is applied to a latch needle circular knitting machine of the rotating cam type. It is to be understood, however, that the invention is also applicable to rotating needle cylinder circular machines, to circular machines employing spring beard needles and to warp knitting machines using either type of such needles.

Figure 1:
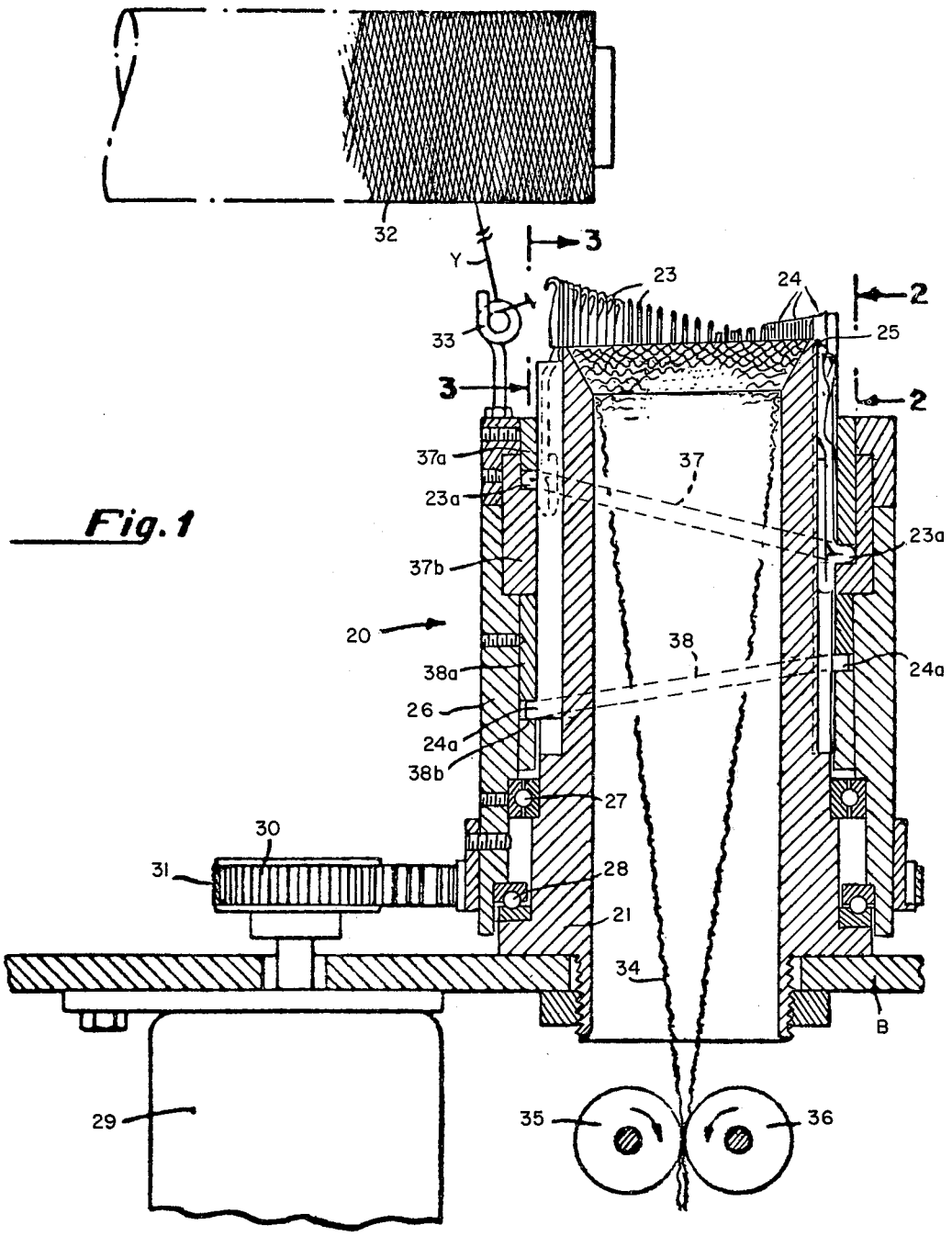
FIG. 1 is a cross-sectional view of a knitting machine of this invention, with certain features illustrated in a schematic fashion.

Referring to FIG. 1 there is shown a circular knitting machine, generally designated as 20, of the rotating cam type. Thus, the machine includes a stationary needle cylinder 21 which is mounted upon a suitable base B. The cylinder 21 is formed with radially outwardly extending fins 22 which are spaced apart to form slots for needles 23 and intervening sliders 24. Thus, a complement of needles 23 is disposed in the cylinder for vertical movement, and a complement of sliders is disposed in said cylinder in alternation with said needles. The top edge of the cylinder (or needle bed) 21 is indicated as 25.

Surrounding the cylinder 21 is a cylindrical cam ring or shell 26 which is supported for rotary movement about the cylinder 21 by ball bearings 27 and 28.

Rotational movement is imparted to the cam ring 26 by a motor 29 positioned below the base B, as shown in FIG. 1. The motor shaft has a pulley 30 which drives a toothed belt 31 which is trained about a suitable track in the ring 26.

Yarn Y is fed to the knitting machine from a source of supply 32, which is schematically shown in FIG. 1, through a feeding eye 33 and thence to the needles 23 where it is formed into a fabric 34 which is drawn from the machine by takeup rolls 35 and 36. As indicated, the fabric may then be passed through a knit-deknit process, if the machine is being used in that connection.

The needles 23 are of the latch type and include lower butts 23*a*. The sliders 24 are also equipped with lower butts 24*a*.

Cam ring 26 is formed with a curved upper race or track 37 for the needle butts 23*a* and a curved lower race or track 38 for the slider butts 24*a*. These tracks 37 and 38 extend around adjacent to the surface of cylinder 21 on the surface of cam ring 26. In the device illustrated, the track 37 is formed by upper and lower continuous rings 37*a* and 37*b*. Similarly, the upper part of track 38 for the slider butts is formed by upper and lower continuous rings 38*a* and 38*b*. Thus, a means is provided for longitudinally moving the needles and the sliders.

Figure 3:
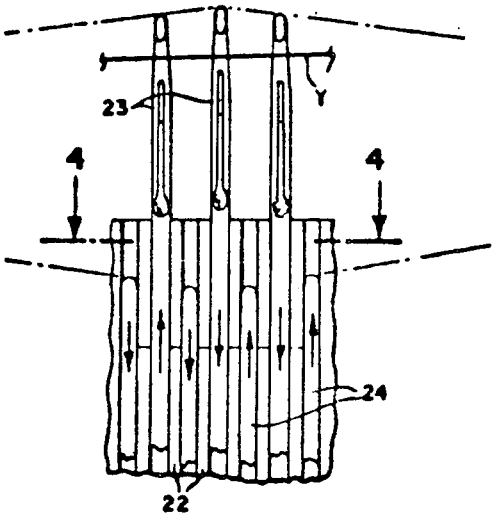
FIG. 3 is a fragmentary elevational view taken in the direction of the arrows 3—3 of FIG. 1.
Figure 4:
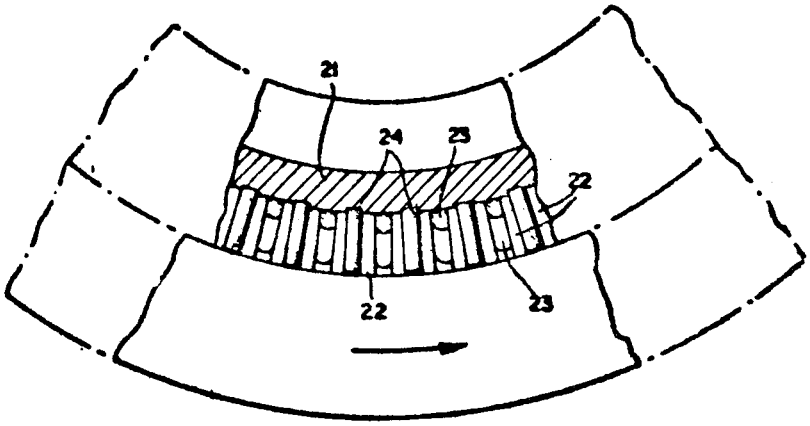
FIG. 4 is a fragmentary view in horizontal cross-section, taken along the line 4—4 of FIG. 3.

As indicated by the arrow in FIG. 4, the cam ring 26 normally rotates in a counter-clockwise direction. In FIG. 1, the needles at the far left are raised to the clearing height at which point they also are in a position to accept the new yarn Y which is being fed through the eye 33, as shown in FIG. 3. As the cam ring 26 rotates, the needle butts or cam followers 23*a* follow the descending path of the track 37 and, accordingly, the needles 23 begin to descend in the stitch forming operation, which descent continues until the needles are drawn to the lowest or castoff level, a position which as shown, is occupied by by the needle at the far right of FIG. 1 and by the third needle from the left in FIG. 2.

With reference to the illustration of the cam track 37 shown in FIG. 5, the needles are in castoff position at the lowest point thereof, whereas they are in clearing position at the highest portion, which is in the center of FIG. 5

In connection with FIG. 5, it will also be observed that the slope of track 37 is substantially uniform and is only approximately 10° from the horizontal, as opposed to the typical 45° of conventional machines. In fact, as shown herein, track 37 is a substantially circular path lying in a plane which has been tilted only 10° from the horizontal.

The cam track 38 for the sliders 24 may be formed with a slope of approximately 6°, as shown in FIG. 5. This, of course, is a relatively shallow path which may be moved relative to the slider butts 24*a* at high speeds.

As is apparent from FIG. 1 and particularly FIG. 5, when the needle cam track 37 is rising the slider cam track 38 is descending. Further, when the needle cam track 37 is descending, the slider cam track 38 is rising. Thus, each of the needles is moved in a direction opposite to the direction of movement of the sliders which are adjacent to said needle.

Figure 2:
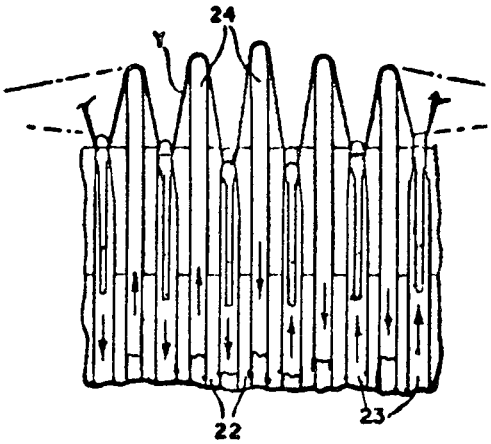
FIG. 2 is a fragmentary elevational view taken in the direction indicated by the arrows 2—2 in FIG. 1.

As shown in FIGS. 1 and 2, the sliders 24 are raised during the downward stitch formation action of the needles 23. The yarn Y is thus required to pass over the top edges of the sliders. As best shown in FIG. 2, the sliders thus assist in measuring out the yarn for the new loops.

It will be understood that the needles 23 would be required to descend substantially lower in the event the sliders 24 were not used. Thus, for example, with reference to FIG. 2, the needles would have to descend substantially below the top edges of the spacers 22 since the latter would then become the edges over which the new stitches would be drawn. Even if the spacers were as high as the top edge 25 of the cylinder 21, the needles would still be required to descend further, by an amount equal to the average distance between the tops of the second and third sliders 24 shown in FIG. 2 and the third needle 23 shown therein, since it is this relative distance that determines the size of the new loops.

However, when the sliders 24 are employed the depth to which the needles must be drawn to effect stitch formation is reduced by the amount the spacers 24 rise. Using this concept, it is thus possible to substantially reduce the slope of the cam track 37 for the needle butts to as low as about one degree from the horizontal, depending upon cylinder diameter and the length of the needle latches, i.e., the greater the diameter and the shorter the latch, the smaller the angle may be. For example, a slope of about ten degrees has produced satisfactory results thus far on a 3¾ inches hosiery machine with 7/16 inch needle latches of the type illustrated in the present drawings.

In any event, it will be understood that the present reduction in the slope of the cam track 37 for the needles enables the machine to be run at substantially higher speeds than in heretofore known machines, since the needles are no longer required to pass down a sharply descending 45° cam. The rate at which the present machine may run, moreover, is increased by the use of sliders 24 to provide the necessary relative distance for stitch-drawing action.

It is to be clearly understood that the terms and expressions used herein are employed as terms of description, and not of limitation, and that there is no intention in using such terms and expressions to exclude any equivalents of the methods described. It is also to be clearly understood that what is specifically shown and described herein represents a preferred embodiment only of the invention and that various changes and equivalents may be resorted to without departing from the principles of the invention or the scope of the claims hereof. Accordingly, it is intended to claim the present invention broadly, as well as specifically as indicated in the appended claims.

I claim:

1. A circular knitting machine for knitting yarn into a fabric having a needle cylinder, a complement of needles disposed in said cylinder for vertical movement, a complement of sliders disposed in said cylinder in alternation with said needles, and cam means extending substantially completely around said cylinder for longitudinally moving said needles and said sliders back and forth so that essentially throughout the entire knitting cycle each of said needles moves in a direction opposite to the direction of movement of the sliders which are adjacent to said needle said cam means providing substantially continuous vertical movement to said needles and sliders.

2. A circular knitting machine for knitting yarn into a fabric having a needle cylinder, a complement of vertically moveable needles disposed for movement back and forth in the cylinder having cam followers thereon, a cam ring surrounding said needle cylinder including means forming a substantially continuous cam track for said needle cam followers, said means extending around substantially the entire circumference of said ring, said track being of a slope of substantially uniform magnitude, a complement of sliders arranged in alternation between said needles, and cam means for moving said sliders back and forth essentially throughout the entire knitting cycle in a direction opposite to that of the adjacent needles.

3. In a circular knitting machine for knitting yarn into a fabric having a needle cylinder with a complement of needles having cam following butts thereon, a cam ring surrounding said cylinder having a curved track extending around adjacent the periphery of said cylinder with a slope of substantially uniform magnitude for said butts formed on the interior wall of said cam ring, for moving said needles back and forth along said cylinder, said track being disposed within an angular range of about 1° to 30° relative to a plane perpendicular to the cylinder axis, a complement of sliders arranged in alternation between said needles, and cam means for moving said sliders back and forth essentially throughout the entire knitting cycle in a direction opposite to the direction of movement of the needles which are adjacent to said sliders.

4. In a knitting machine for knitting yarn into a fabric having a needle bed with a complement of needles having cam following butts thereon, needle cam means associated with said bed forming a needle cam track for said butts and arranged for moving said needles back and forth along their axes in said bed, said needle cam track traversing substantially continuously all of said bed and having a slope of substantially uniform magnitude and disposed at an angle within an angular range of about 1° to 30° relative to a plane perpendicular to the axis of the needle bed, a plurality of sliders positioned between said needles for movement back and forth parallel to said needles, slider cam means associated with said bed forming a slider cam track for said sliders which traverses substantially continuously all of said bed; and said slider cam track being angled to move said sliders essentially throughout the knitting cycle in opposite directions to the directions of movement of said needles.

5. The invention of claim 4 wherein said angular range is about 1° to 10°.

6. In a circular knitting machine for knitting yarn into a fabric the combination comprising:

a. a cylinder having a plurality of spaced vertical slots arranged about the outer periphery thereof, b. a complement of needles disposed in cylinder slots for vertical movement back and forth therein, said needles having cam following butts, c. a complement of vertically moveable sliders disposed in slider slots arranged parallel to and in alternation with said needle slots for movement of said sliders back and forth along their axes, said sliders having cam following butts and upper end portions for engaging yarn extending between adjacent needle hooks during stitch formation.

d. needle cam means for guiding vertical movement of said needle butts, said needle cam means comprising a cam track extending substantially continuously around substantially the entire circumference of said cylinder and having a slope of substantially uniform magnitude, said track being disposed at an angle within an angular range of 1° to 40° relative to a plane perpendicular to the cylinder axis, e. slider cam means for guiding vertical movement of said slider butts, and, f. means for imparting relative movement between said cylinder and said cam means.

7. The invention of claim 6 wherein said cam track slope subtends an angle of about 10° relative to a plane perpendicular to the cylinder axis.

8. A method of high speed knitting of yarn on a circular knitting machine having a cylinder for vertically moveable alternately disposed needles and sliders, cam means for moving said needles and sliders back and forth, means for moving the cam means and needles and sliders relative to one another, and a supply of yarn, comprising the steps of:

a. passing a strand of the yarn adjacent the needles.

b. raising needles to take the yarn in their hooks.

c. lowering the needles continuously around approximately one-half of the cylinder along a substantially uniform slope at an angle within an angular range of 1° to 40° relative to a plane perpendicular to the cylinder axis to form the yarn into downward loops while concurrently throughout essentially said one-half of the cylinder raising the sliders so that the latter engage and raise the yarn into upward loops on the sides of the lowering needles, to measure out a desired length of a new stitch, and whereby the old loop is cast-off.

9. The invention of claim 8 wherein the needles are lowered along a substantially uniform path having a slope of about 10° from a plane perpendicular to the cylinder axis.

10. In a circular knitting machine the combination comprising:

a. a cylinder having a plurality of spaced vertical slots arranged about the outer periphery thereof, b. a complement of needles disposed in cylinder slots for vertical movement therein, said needles having cam following butts, c. a complement of vertically moveable sliders disposed in said slots in alternation with said needles, said sliders having cam following butts and upper end portions for engaging yarn extending between adjacent needle hooks during stitch formation, d. needle cam means for guiding vertical movement of said needle butts, said cam means comprising a cam track extending substantially continuously around substantially the entire circumference of said cylinder and having a slope of substantially uniform magnitude, said track being disposed at an angle within an angular range of 1° to 40° relative to a plane perpendicular to the cylinder axis, e. slider cam means for guiding vertical movement of said slider butts, and f. means for imparting relative movement between said cylinder and said cam means, wherein the slider cam means includes a continuous slider track for guiding the slider butts and wherein said slider track has a slope of substantially uniform magnitude subtending an angle of about 6° relative to a plane perpendicular to the cylinder axis.

* * * * *